United States Patent [19]

Palty

[11] 4,400,647

[45] Aug. 23, 1983

[54] CATHODE STRUCTURE FOR CATHODE RAY TUBES AND METHOD

[75] Inventor: George Palty, Seneca Falls, N.Y.

[73] Assignee: North American Philips Consumer Electronics Corp., New York, N.Y.

[21] Appl. No.: 295,877

[22] Filed: Aug. 24, 1981

[51] Int. Cl.[3] ..... H01J 1/02

[52] U.S. Cl. ..... 313/355; 313/346 R; 313/352; 427/77

[58] Field of Search ..... 252/500, 510; 427/77, 427/78; 428/375; 313/355, 352, 346 R, 346 DC

[56] References Cited

U.S. PATENT DOCUMENTS

| | | | |
|---|---|---|---|
| 2,876,139 | 3/1959 | Flowers | 313/355 |
| 2,904,717 | 9/1959 | Kerstetter | 313/355 |
| 3,113,236 | 12/1963 | Lemmens et al. | 313/346 DC |
| 3,240,569 | 3/1966 | Buescher | 313/346 R |
| 4,279,784 | 7/1981 | Misumi et al. | 313/346 DC |

*Primary Examiner*—Harold A. Dixon

*Attorney, Agent, or Firm*—Thomas A. Briody; Jack Oisher; John C. Fox

[57] ABSTRACT

Cathode structures for cathode ray tubes are multilayer structures wherein the multilayer structures are formed from a laminate of at least two self-supporting layers of particles of emissive material dispersed in a fugitive organic binder matrix.

10 Claims, 3 Drawing Figures

CATHODE STRUCTURE FOR CATHODE RAY TUBES AND METHOD

BACKGROUND OF THE INVENTION

1. Field of the Invention

This invention relates to cathode structures for cathode ray tubes, and to a method for producing them, and more particularly relates to multilayer cathode structures produced from laminates of at least two self-supporting layers, each layer having essentially the same composition.

2. Prior Art

Cathode structures for cathode ray tubes desirably exhibit uniform electron emissions over an extended life cycle and under a variety of operating conditions. In addition, such cathode structures may be manufactured at the lowest possible cost. Because of such stringent requirements, particularly reliability and cost, there is great reluctance on the part of high volume manufacturers of cathode ray tubes to introduce new cathode structures or methods. Nevertheless, presently used cathode structures and methods exhibit limitations sufficiently troublesome to justify continuing investigations of alternate structures and methods.

These limitations include poor adherence of the emissive layer to its substrate, non-uniformity of emissions, and variations in the cathode-to-grid spacings ($K-G_1$ spacings) of the electron gun, resulting in out-of-specification values for cut-off voltages. Both non-uniformity of emissions and variations in the $K-G_1$ spacings can result from non-uniformity in the thickness of the emissive layer. Particularly in the case of the sprayed coatings widely in use today, such non-uniform thicknesses occur not only from one cathode coating to another, but also within a single cathode coating. Sprayed coatings tend to lack not only the thickness uniformity, but also the degree of surface smoothness of coatings produced by other techniques, such as casting a film of the potentially emissive material in an organic binder matrix. See U.S. Pat. Nos. 2,974,364; 2,986,671; and 3,223,569, assigned to the present assignee. Such variations in thickness and surface smoothness can lead to variations in quality of the spot produced from the impingement of the electron beam on the phosphor screen.

Where the thickness of the cathode emissive layer desired is greater than that achieved by a single coating operation, such as spraying or casting of a self-supporting film, multiple applications are called for, thus compounding the complexity of the operation, and adversely affecting the reliability and cost of the resultant structure.

U.S. Pat. Nos. 4,197,152 and 4,197,153, assigned to the present assignee, describe the formation of cathode structures by attaching self-supporting emissive films to the cathode support, such films centered and adhered to the support by a solvent drop thereon. However, such films are currently less satisfactory in thicknesses in excess of about 0.003 inches, due to limitations in the process of forming them.

Accordingly, objectives of the present invention include: providing a cathode structure for cathode ray tubes with an emissive layer which exhibits both uniformity of thickness and surface smoothness; providing such a structure with an emissive layer which exhibits an overall thickness greater than that achieved by single coating operations; and providing a method for producing such structures simply and reliably.

SUMMARY OF THE INVENTION

Cathode structures for cathode ray tubes are multilayer structures wherein the layers are produced from laminates of self-supporting layers of particles of emissive material dispersed in a fugitive organic binder matrix. The laminates may be produced and applied to the supporting substrate in a single operation.

In accordance with broad aspects of the invention, there is provided a cathode structure for cathode ray tubes comprising: a supporting substrate of a nickel alloy; and a multilayer electron emissive structure adherent to the substrate; characterized in that the electron emissive structure is formed from a laminate of at least two self-supporting layers, each layer comprised of particles of an electron emissive material dispersed in a fugitive organic binder matrix.

The inorganic particles from which the electron emissive material is formed consist essentially of a mixture, usually co-precipitated, of particles of alkaline earth carbonate selected from the group consisting of barium, strontium and calcium carbonates.

Preferably, barium carbonate is present in the amount of about 55 to 60 weight percent, strontium carbonate is present in the amount of about 36 to 45 weight percent, and calcium carbonate is present in the amount of about 0 to 4 weight percent.

In accordance with another aspect of the invention, there is provided a method for producing a cathode structure for cathode ray tubes, the method comprising: depositing a drop of solvent onto a supporting substrate of a nickel alloy; forming a laminated button of at least two self-supporting layers, each layer comprised of particles of electron emissive material dispersed in a fugitive organic binder matrix; floating the button on the drop; and selectively evaporating the solvent to center and adhere the button to the substrate.

In accordance with another preferred embodiment of the method, following evaporation of the solvent, the structure is: first heated to a temperature sufficient to substantially remove the fugitive organic binder, and to substantially convert the alkaline earth carbonates to alkaline earth oxides; and then heated in a vacuum at a higher temperature, such higher temperature sufficient to activate the cathode structure by reducing at least a portion of the alkaline earth oxides to base metal, and to sinter at least a portion of the particles to each other and to the substrate.

In accordance with a preferred embodiment of the method, the laminated button is formed and floated on the drop in a single operation after depositing the drop by bringing into contact portions of at least two endless tapes of self-supporting material above the drop, punching a button from the tape in the area of contact, and allowing the button to fall onto the drop.

DESCRIPTION OF THE PREFERRED EMBODIMENT

Figure 1:
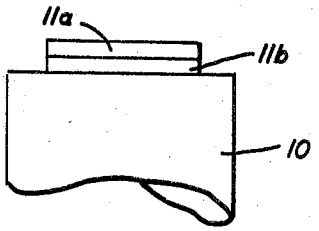
FIG. 1 is a front elevation view of one embodiment of a cathode structure of the invention, having a two-layer structure adherent to the substrate.

Referring now to FIG. 1, there is shown one embodiment of a cathode structure of the invention, wherein substrate 10 supports a two-layer electron emissive structure 11, composed of a first layer 11*a* in contact with the substrate and a second layer 11*b* of essentially the same composition in contact with the first layer. Substrate 11 is composed of an alloy of nickel typically containing about 2 to 4 weight percent tungsten, up to about 0.1 weight percent zirconium, remainder substantially nickel. Typical commercial alloys used for this purpose are known by the tradenames "Nitung 4", having a composition of about 96 weight percent nickel, 4 weight percent tungsten and "Nizir-W", having a composition of about 98 weight percent nickel, about 2 weight percent tungsten and about 0.05 weight percent zirconium.

The electron emissive material in structure 11 is composed of products of the thermal decomposition or breakdown and activation of barium carbonate and strontium carbonate, and optionally calcium carbonate. As is known, such breakdown and activation converts these alkaline earth carbonates first to their respective oxides (by thermal decomposition) and then to base metal (under the influence of a reducing agent such as tungsten in the substrate). Because of its relatively low work function, barium is the primary source of electrons.

Figure 2:
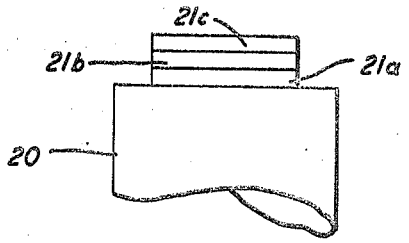
FIG. 2 is a front elevation view of another embodiment of a cathode structure of the invention, having a three-layer structure adherent to the substrate.

Referring to FIG. 2, there is shown another embodiment of the cathode structure of the invention, wherein substrate 20 supports a three-layer electron emissive structure 21, containing electron emissive material. Such a three-layer structure provides a greater overall emissive layer thickness than the two-layer structure of FIG. 1.

Figure 3:
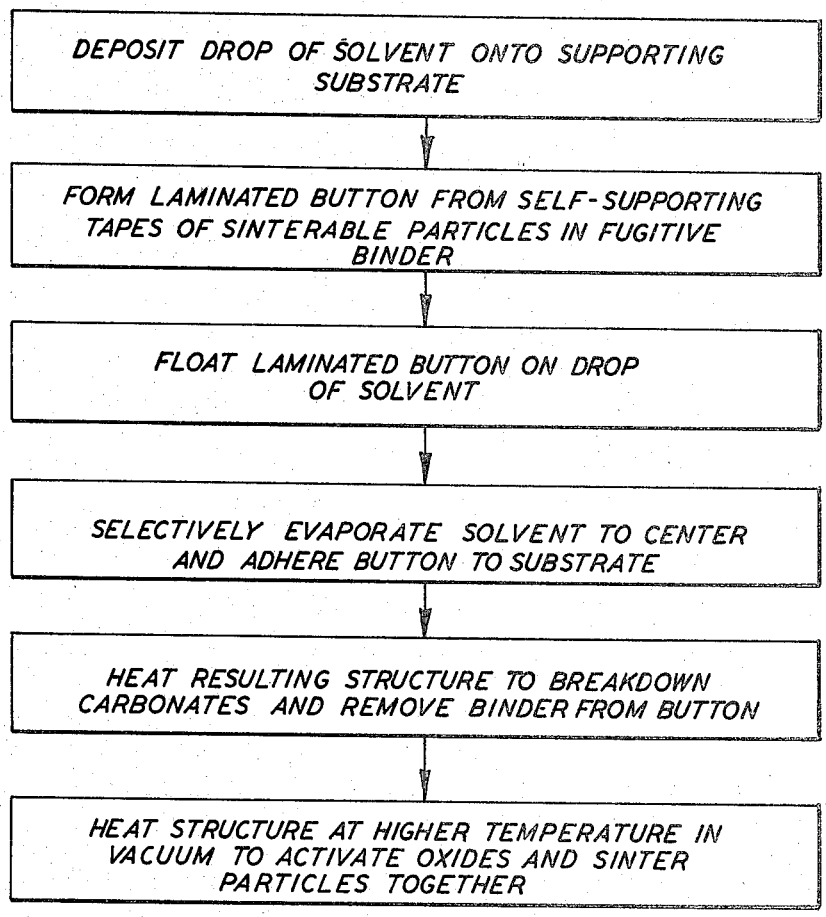
FIG. 3 is a block flow diagram illustrating one embodiment of a method for producing the cathode structure of the invention.

Referring now to FIG. 3, there is shown a block flow diagram, representing the essential steps of a method for producing the cathode structure of the invention. The first two steps are the deposition of a drop of solvent onto the supporting substrate and the formation of a laminated button of self-supporting layers of inorganic particles in a fugitive organic binder matrix. The laminated buttons are preferably formed by bringing into contact above the drop of solvent at least a portion of two endless tapes (tapes of indeterminate length) of the self-supporting layers and punching out the buttons in the region of contact. Each button then falls a short distance to float on the solvent drop resting on the substrate.

Methods, compositions and apparatus suitable for producing such self-supporting tapes are known and are described, for example, in U.S. Pat. Nos. 4,197,152; 4,197,153; 3,323,879; 3,171,817; 2,986,671; 2,974,364; and 2,965,927, all assigned to the present assignee. The preferred composition for this application is an ethyl cellulose-based composition, although acrylic-based and nitrocellulose-based compositions should work equally as well. One ethyl cellulose-based composition listed in U.S. Pat. No. 2,986,671, would additionally contain toluene, alcohol, ethylene carbonate, ethyl acetate, barium nitrate and diethylene glycol monobutyl ether, known by the trade-name butyl "Carbitol". The tapes typically have a thickness of about 0.001 to 0.003 inches and the buttons typically have a diameter of about 0.070 inch, and a thickness of about 0.002 to 0.006 inches.

The solvent is any solvent which will dissolve the organic binder matrix in whole or in part. However, it is preferred to use a mixture of polar and non-polar liquids, wherein the non-polar liquid is the solvent, as more fully described in U.S. Pat. Nos. 4,197,152 and 4,197,153, assigned to the present assignee.

A suitable solvent mixture for an ethyl cellulose-based self-supporting layer would include water and ethylene glycol monobutyl ether, known by the trade-name as butyl "Cellosolve". The water would be in the range of about 50 to 90 percent by weight while the butyl "Cellosolve" would be in the range of about 10 to 50 percent by weight. Moreover, one preferred embodiment includes a solvent mixture of about 65 percent by weight water and about 35 percent by weight of butyl "Cellosolve".

At least one rounded drop of a suitable solvent or solvent mixture, such as described above, is deposited onto the substrate. At least one rounded drop or an amount at least sufficient to initially "float" an applied button is a minimum requirement. However, amounts greater than a rounded drop have not proven to be deleterious or harmful. Thus, a drop in an amount sufficient to completely wet the substrate and sufficient to "float" an applied button of self-supporting layers is provided.

Following, the substrate with the button initially "floating" on the rounded drop is heated in an amount sufficient to evaporate the solvent or preferentially evaporate the liquids of the solvent mixture. For the water-butyl "Cellosolve" mixture described above, heating is first carried out in the temperature range of about 60° C. to 120° C. Thereafter, additional heat is added in an amount to evaporate the higher boiling liquid, wherein the binder of the layers is soluble, and causes the binder in the layers to affix the button to the substrate. For the water-butyl "Cellosolve" mixture, such heating is carried out in the temperature range of about 160° C. to 200° C.

The laminated button now adhered to the substrate contains "potentially emissive" material, so referred to because only subsequent processing renders the material electron emissive. Such processing normally takes place during and immediately after evacuation of the cathode ray tube and sealing of the electron gun in the evacuated tube. Such processing is referred to as "breakdown" and "activation", wherein during tube evacuation the alkaline earth carbonates are broken down or thermally decomposed to the respective oxides, and subsequently the oxides are activated to base metal, in which form barium in particular is electron emissive. During heating to achieve breakdown, which normally occurs at a temperature of about 900° C., the organic binder is also removed from the cathode structure. During activation, which normally occurs normally occurs at a temperature of about 1050° C., some sintering together of the remaining inorganic particles in the structure occurs, as well as some sintering of the particles to the substrate. Such structures are characterized by a high degree of thickness uniformity and surface smoothness. For example, the thickness of the self-supporting tapes used to form the laminated buttons will normally vary no more than about 0.0001 inch. Surface is very much smoother than can be achieved with any of the sprayed coatings now in use. Such thickness uniformity and surface smoothness are preserved in the activated cathode structure, enabling close control of cathode-to-grid spacing (and thus cut-off voltage), as well as uniform electron emissions, resulting in uniform spot quality at the screen. For example, using the cathode structures of the invention, K-$G_1$ spacings are obtainable which vary only 0.0001 inch, versus 0.0005 inch for sprayed cathode coatings.

INDUSTRIAL APPLICABILITY

Cathode structures described herein are particularly suitable for use in cathode ray tubes for color and black-and-white entertainment and data display applications.

I claim:

1. A cathode structure for cathode ray tubes comprising:

(a) a supporting substrate of a nickel alloy; and (b) a multilayer electron emissive structure adherent to the substrate, characterized in that the electron emissive structure is formed from a laminate of at least two self-supporting layers, each layer comprised of particles of an electron emissive material dispersed in a fugitive organic binder matrix.

2. The structure of claim 1 wherein the inorganic particles from which the electron emissive material is formed consist essentially of a mixture of particles of alkaline earth carbonate selected from the group consisting of barium, strontium and calcium carbonates.

3. The structure of claim 2 wherein barium carbonate is present in the amount of about 55 to 60 weight percent, strontium carbonate is present in the amount of about 36 to 45 weight percent, and calcium carbonate is present in the amount of about 0 to 4 weight percent.

4. The structure of claim 1 wherein the nickel alloy substrate contains from about 2 to 4 weight percent tungsten, from about 0 to 0.1 weight percent zirconium, remainder substantially nickel.

5. The structure of claim 1 wherein the thickness of each self-supporting layer is in the range of from about 0.001" to 0.003".

6. A method for producing a cathode structure for cathode ray tubes, the method comprising:

(a) depositing a drop of solvent onto a supporting substrate of a Ni alloy;

(b) forming a laminated button of at least two self-supporting layers, each layer comprised of particles of electron emissive material dispersed in a fugitive organic binder matrix;

(c) floating the button on the drop; and (d) selectively evaporating the solvent to center and adhere the button to the substrate.

7. The method of claim 6 wherein the potentially emissive material consists essentially of a mixture of particles of alkaline earth carbonates selected from the group consisting of barium, strontium and calcium carbonates.

8. The method of claim 7 wherein barium carbonate is present in the amount of about 55 to 60 weight percent, strontium carbonate is present in the amount of about 36 to 45 percent, and calcium carbonate is present in the amount of about 0 to 4 weight percent.

9. The method of claim 6 wherein after depositing the drop, the laminated button is formed and floated by bringing into contact portions of at least two endless tapes of self-supporting material, above the drop, punching a button from the tapes in the area of contact, and allowing the button to fall onto the drop.

10. The method of claim 6 wherein following evaporation of the solvent, the structure is: first heated to a temperature sufficient to substantially remove the fugitive organic binder, and to substantially convert the alkaline earth carbonates to alkaline earth oxides; and then heated in a vacuum at a higher temperature, such higher temperature sufficient to activate the cathode structure by reducing at least a portion of the alkaline earth oxides to base metal, and to sinter at least a portion of the particles to each other and to the substrate.

* * * * *